United States Patent [19]

Hoppin, III

[11] Patent Number: 4,907,947

[45] Date of Patent: Mar. 13, 1990

[54] HEAT TREATMENT FOR DUAL ALLOY TURBINE WHEELS

[75] Inventor: George S. Hoppin, III, Scottsdale, Ariz.

[73] Assignee: Allied-Signal Inc., Phoenix, Ariz.

[21] Appl. No.: 226,322

[22] Filed: Jul. 29, 1988

[51] Int. Cl.[4] ..... F01D 5/34

[52] U.S. Cl. ..... 416/241 R; 416/213 R; 416/244 A; 148/162

[58] Field of Search ..... 416/241 R, 213 R, 244 R; 29/156.8 R, 156.8 F; 228/231, 243; 419/8, 26, 54; 148/11.5 N, 11.5 Q, 11.5 R, 11.5 P

[56] References Cited

U.S. PATENT DOCUMENTS

| | | | |
|---|---|---|---|
| Re. 32,389 | 7/1987 | Becker et al. | 29/157.1 R |
| 3,803,702 | 4/1974 | Bratt et al. | 29/420.5 |
| 3,940,268 | 2/1976 | Catlin | 75/208 R |
| 4,063,939 | 12/1977 | Weaver et al. | 75/208 R |
| 4,090,873 | 5/1978 | Takamura et al. | 75/208 R |
| 4,096,615 | 6/1978 | Cross | 29/156.8 R |
| 4,097,276 | 6/1978 | Six | 75/208 R |
| 4,152,816 | 5/1979 | Ewing et al. | 29/156.8 R |
| 4,240,495 | 12/1980 | Vonnegut | 416/241 R |
| 4,335,997 | 6/1982 | Ewing et al. | 416/185 |
| 4,479,293 | 10/1984 | Miller et al. | 29/156.8 R |
| 4,494,287 | 1/1985 | Cruzen et al. | 29/156.8 R |
| 4,526,747 | 7/1985 | Schimmel et al. | 419/8 |
| 4,529,452 | 7/1985 | Walker | 228/243 X |
| 4,581,300 | 4/1986 | Hoppin, III et al. | 428/546 |
| 4,587,700 | 5/1986 | Curbishley et al. | 29/156.8 R |
| 4,640,815 | 2/1987 | Brosius et al. | 419/8 |
| 4,659,288 | 4/1987 | Clark et al. | 416/186 R |
| 4,677,035 | 6/1987 | Fieldler et al. | 29/156.8 R X |
| 4,680,160 | 7/1987 | Helmink | 419/6 |
| 4,722,469 | 2/1988 | Rydstad et al. | 228/231 X |
| 4,814,139 | 3/1989 | Tokunaga et al. | 419/54 X |

*Primary Examiner*—E. A. Powell, Jr.
*Attorney, Agent, or Firm*—R. Steven Linne; Jim W. McFarland

[57] ABSTRACT

A dual alloy gas turbine rotor is heat treated by HIP bonding a cast superalloy blade ring to a consolidated, powdered-metal hub. After bonding, the assembly is solution treated and aged at certain specific temperatures so as to optimize the mechanical properties of the dual alloy assembly for use in a high performance gas turbine engine.

10 Claims, 1 Drawing Sheet

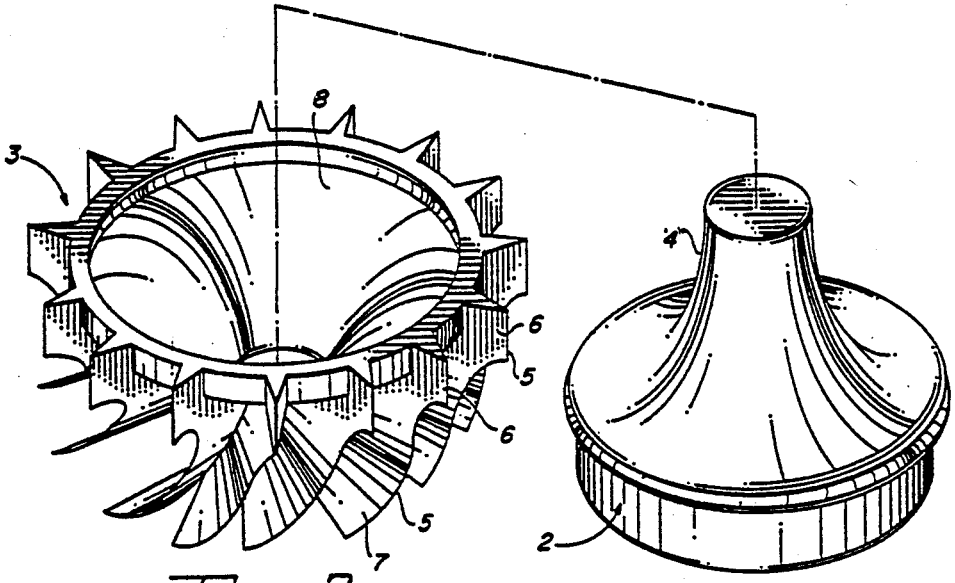
FIG. 3
FIG. 2
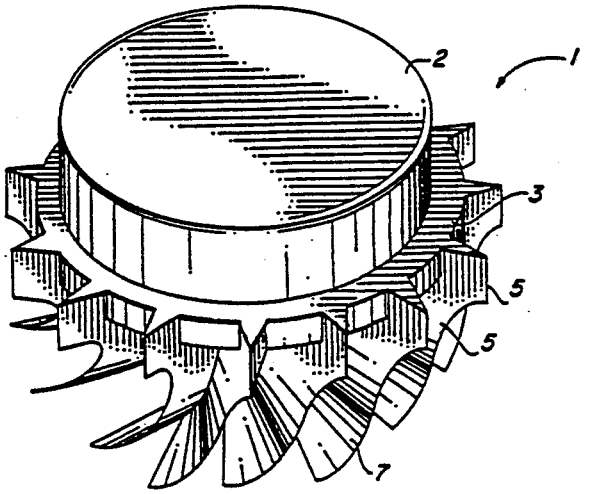
FIG. 1

HEAT TREATMENT FOR DUAL ALLOY TURBINE WHEELS

This invention was made with Government support under Contract Number DAAJ02-86-C-0006 awarded by the U.S. Army. The Government has certain rights in this invention.

TECHNICAL FIELD

This invention relates generally to the metallurgical arts and more specifically to a method of heat-treating certain components made from two different nickel-base superalloys.

BACKGROUND OF THE INVENTION

Radial turbine rotors or wheels in gas turbine engines are subjected to very high temperatures, severe thermal gradients, and very high centrifugal forces. The turbine blades are located directly in and are directly exposed to the hot gas-stream. The inducer tips of the blades therefore experience the highest temperatures and consequently are most susceptible to creep rupture failure that could result in an inducer tip striking the surrounding nozzle enclosure, causing destruction of the turbine. The turbine hub is subjected to very high radial tensile forces and also has a life limit imposed by low-cycle-fatigue crack initiation and growth. In order to achieve optimum blade and hub material properties, dual alloy structures have been developed in which the hub portion is formed of wrought superalloy material having high tensile strength and high low-cycle fatigue strength, while the blade ring portion, including the blades (i.e., airfoils) and blade rim, is formed of a cast superalloy material having high creep rupture strength at very high temperatures. The dual alloy approach has been used where very high performance turbine rotors are required because those materials that have optimum properties for the turbine blades do not have sufficiently high tensile strength and sufficiently high low-cycle fatigue strength for use in the turbine hubs.

U.S. Pat. No. 4,581,300 issued Apr. 8, 1986 to Hoppin et al and U.S. Pat. No. 4,659,288 issued Apr. 21, 1987 to Clark et al, both assigned to the assignee of the present invention, disclose methods for manufacturing a turbine rotor from two portions each having a different superalloy composition. The disclosures of said patents are incorporated herein by reference to aid in understanding the background of the present invention.

One problem in manufacturing such dual alloy components is in selecting the proper heat treating cycle to optimize the mechanical properties of both superalloy components. Obviously, selecting the thermal treatment employed to maximize strength of one of the alloys would not be expected to be optimum for a component containing a second alloy. Further, it would be apparent to those skilled in this art that merely "splitting the difference" between the temperatures and times of the two alloys' usual thermal treatment would be even less satisfactory and may even be totally useless (i.e., both components may have poor mechanical properties).

The aforementioned U.S. Pat. No. 4,659,288 teaches one method to heat treat a dual alloy turbine wheel in column 6, lines 5 to 35. However, the procedure is lengthy (about 36 to 48 hours) and complex (5 furnace cycles). In view of the foregoing, it should be apparent that there is an unmet need in the art for improvements in the heat treating of dual alloy components for use as turbine rotors in high performance gas turbine engines.

It is therefore an object of the present invention to provide a novel method for improving the mechanical properties of certain dual alloy components. It is a further object of the present invention to provide a new and improved method of heat treating alloy turbine rotors for use in high performance gas turbine engines.

SUMMARY OF THE INVENTION

The present invention aims to overcome the disadvantages of the prior art as well as offer certain other advantages by providing a faster and simpler method of heat treating dual alloy turbine rotors of the type having a MAR M-247 cast superalloy blade ring and a powder metal ASTROLOY superalloy hub.

Basically, the process involves HIP-bonding a fine-grained, cast blade ring to a pre-consolidated powdered metal hub at about 2230° F. (1220° C.) and 15,000 psi pressure for about 4 hours followed by furnace cooling. The bonded assembly is solution treated at about 2040° F. (1115° C.) for about 2 hours followed by rapid air cooling. Next the assembly is double aged: first at about 1600° F. (870° C.) for 16 hours and air cooled, then for a second time at 1400° F. (760° C.) for 16 hours and air cooled to room temperature.

This new heat treatment produces superior stress-rupture life in the blade ring and good strength and ductility in the hub as compared to prior art processing methods.

BRIEF DESCRIPTION OF THE DRAWINGS

While this specification concludes with claims particularly pointing out and distinctly claiming the subject matter which is regarded as the invention, it is believed that the objects, features, and advantages thereof may be better understood from the following detailed description of a presently preferred embodiment when taken in connection with the accompanying drawings in which:

FIG. 1 is a perspective illustration of a dual alloy turbine wheel assembly after bonding:

FIG. 2 is an illustration of the inner hub portion of the turbine wheel before bonding; and FIG. 3 is an illustration of the outer blade ring portion of the turbine wheel.

BEST MODE FOR CARRYING OUT THE INVENTION

A radial flow turbine wheel (1) shown in FIG. 1 before final machining, includes a central hub portion (2) and an outer blade ring portion (3). The generally conical blade ring (3) includes a plurality of thin, curved blades or airfoils (5) each having an inducer tip (6), extending radially from the largest diameter portion of the wheel, and an exducer tip (7) extending outwardly from the smaller diameter portion of the wheel. In use, hot gases impinge on the inducer tips (6), flow down the blade surfaces (5) causing the wheel to rotate, and leave the wheel in a generally axial direction past the exducer tips (7).

In a dual alloy wheel, the hub (2), best seen in FIG. 2, is formed from a superalloy material having high tensile strength and good low-cycle fatigue strength in order to withstand the high centrifugal and thermal stresses during operation and imposed by prolonged cyclic operation. A preferred superalloy material is consolidated, low carbon, ASTROLOY powder having a nominal composition of about: 15% Cr, 17% co, 5.3% Mo, 4% Al, 3.5% Ti, 0.03% C, 0.02% B and the balance nickel plus impurities. Preferably, this alloy is consolidated by hot isostatic pressing (HIP) the powder to near final shape at about 2230° F. (1220° C.) under 15,000 psi pressure for about 4 hours followed by slow furnace cooling. Usually, unitary components made from this alloy would be heat treated by: solutionizing at 2040° F. (1115° C.) for 2 hours and rapid air cooling, stabilization at 1600° F. (870° C.) for 8 hours with air cooling, and again at 1800° F. (980° C.) for 4 hours, followed by precipitation hardening at 1200° F. (650° C.) for 24 hours with air cooling, and again at 1400° F. (760° C.) for another 8 hours. This is the so-called "yo-yo" heat treatment originally developed for forged components made of the higher carbon version of this alloy.

The blade ring portion (3) of a dual alloy wheel, as shown in FIG. 3, is formed from a different superalloy material having good high-temperature creep strength and resistance to thermal fatigue. A preferred material is a fine grain casting of MAR M-247 which has a nominal composition of about: 8.2% Cr, 10% Co, 0.6% Mo, 10% W, 3% Ta, 5.5% Al, 1% Ti, 0.16% C, 0.02% B, 0.09% Zr, 1.5% Hf and the balance nickel plus impurities. Typically, this casting is consolidated by HIPing at about 2165° F. (1185° C.) under about 25,000 psi pressure for about 4 hours followed by slow furnace cooling. Usually, cast components made entirely from this alloy have been heat treated by solutionizing at 2165° F. (1185° C.) for 2 hours and rapid air cooling followed by aging at 1600° F. (870° C.) for about 20 hours and air cooling to room temperature.

However, to manufacture a dual alloy wheel (1), the hub (2) must be bonded to the blade ring (3) before the final heat treatment of the assembly. Typically, the outer surface (4) of the hub (2) and the inner surface (8) of the blade ring (3) are both machined to provide a clean, smooth, close-fitting bonding surface. The two portions are assembled and diffusion bonded under pressure for several hours at about 2000° to 2300° F. (1090° to 1260° C.). The unitary bonded assembly is then ready for a final heat treatment to fully develop the desired mechanical properties in each portion of the wheel.

It should be apparent that the previously used heat treating cycles for each of the two materials are so significantly dissimilar from one another that neither cycle would be expected to maximize mechanical properties in the other alloy. Several tests were performed to substantiate, and determine the severity of, this perceived incompatability.

Individual test components of the two superalloy compositions were procured in the HIP - consolidated condition and subjected to a simulated thermal bonding cycle of 2225° F. (1218° C.) for 4 hours in preparation for the series of tests set out below.

EXAMPLE I

To provide a basis for comparison, several ASTROLOY components were heat treated according to the usual temperature and times set forth above (i.e. the "yo-yo" heat treatment). Those foregoing processing steps produced ASTROLOY components having an average yield strength of 124,700 psi and an ultimate tensile strength of 186,200 psi. Creep-rupture testing of similar components at 1300° F. (700° C.) under a 100,000 psi load, gave a time to failure of 163.6 hours and an elongation of 26.6 percent.

Likewise, MAR M-247 components were heat-treated according to the usual cycle for such castings as set forth above. Such a heat treating cycle produced MAR M-247 components having an average yield strength of 118,100 psi and an ultimate tensile strength of 144,000 psi. Creep-rupture testing of the components, at 1500° F. (815° C.) under a 75,000 psi load, gave a time to failure of 46.6 hours and an elongation of about 1.5 to 1.7 percent.

EXAMPLE II

In order to determine the detrimental effects of heat treating both components of a dual alloy wheel by either one of the previously recommended processes, ASTROLOY components were heat treated according to the recommended MAR M-247 cycle and MAR M-247 components were treated according to the usual cycle for ASTROLOY.

Testing of these components indicated that their yield and tensile strengths were not significantly reduced and the creep-rupture properties were even improved somewhat. These ASTROLOY components averaged 118,000 psi yield strength (down 5½%), 186,800 psi tensile strength (same as Example I), 191.6 hours to rupture (up 17%) and 27.9% creep elongation (up 5%). The MAR M-247 castings averaged 122,000 psi yield strength (up 3½%), 147,000 psi tensile strength (up 2½%), 110.3 hours to rupture and 2.9% creep elongation (both about doubled from Example I).

While these test results were better than expected, a close examination of the creep test curves indicated that both heat treatments (Examples I and II) of the MAR M-247 castings caused the specimens to fail during second-stage creep; i.e., prematurely. Further testing was undertaken to try to overcome this defect and to find a single heat treating cycle which produced improved properties in both components of a dual alloy turbine wheel.

EXAMPLE III

Test components of both alloys were solutionized at 2040° F. (1115° C.) for 2 hours and rapidly air cooled to room temperature. They were then treated at 1600° F. (870° C.) for 16 hours and allowed to air cool. A final treatment at 1400° F. (760° C.) for 16 hours, followed by air cooling, prepared the components for testing. The data below indicates that their yield and tensile strengths were not significantly different from the baseline data of Example I but the creep-rupture strength of the MAR M-247 alloy was greatly improved. More importantly, examination of the creep test curves showed that this improved heat treating cycle allowed the MAR M-247 test components to proceed to third stage creep and fail "normally". This improvement was quite unexpected and the exact reasons for such improvement has not yet been exactly determined.

The tests of the Astroloy components showed: 121,300 psi yield strength (down 3%): 187,500 psi tensile strength (same), 158.9 hours to rupture (down 3%) and 30.5% creep elongation (up 15%).

The MAR M-247 castings averaged 121,600 psi yield strength (up 3%), 147,400 psi tensile strength (up 2½%), 227.7 hours to rupture and 7.4% creep elongation (both increased about 4½ times over Example I).

The foregoing heat treating procedure produces a dual alloy turbine rotor assembly suitable for final machining, having extremely high material strengths optimized in both the hub and blade portions at relatively lower costs than the prior art methods.

While in order to comply with the statute, this invention has been described in terms more or less specific to one preferred embodiment, it is expected that various alterations, modifications, or permutations thereof will be apparent to those skilled in the art. For example, the hub portion is preferably consolidated from powdered metal but it may equally well be machined from a wrought billet. In addition, various vendors may sell similar superalloys under different names thus UDIMET 700 may be substituted for ASTROLOY. The example described is for a dual alloy radial turbine but the process is equally applicable to dual alloy axial turbine wheels. Therefore, it should be understood that the invention is not to be limited to the specific features shown or described but it is intended that all equivalents be embraced within the spirit and scope of the invention as defined by the appended claims.

What is claimed is:

1. A method of heat-treating a dual alloy component of the type having a first portion made from a first nickel base superalloy containing about 15% Cr, 17% Co, 5.3% Mo, 4% Al and 3.5% Ti and a second portion made from a second nickel base superalloy containing about 8.2% Cr, 10% Co, 0.6% Mo, 10% W, 3% Ta, 5.5% Al and 1% Ti, comprising the steps of:

heating the component at about 2040° F. for about two hours, rapidly air cooling the component to room temperature, reheating the component to about 1600° F. for about 16 hours, allowing the component to cool, reheating the component to about 1400° F. for 16 hours, and allowing the component to cool.

2. The method of claim 1 further including a preliminary step of bonding said first portion to said second portion by hot isostatic pressing the two portions together at about 2225° F. under about 15,000 psi pressure for about four hours.

3. The method of claim 2 wherein said first portion is consolidated from powders of said first superalloy prior to bonding.

4. The method of claim 2 wherein said second portion is cast from said second superalloy prior to bonding.

5. A method of manufacturing a dual alloy turbine rotor for a high performance gas turbine engine, comprising the steps of:

providing a hub portion made from a first nickel base superalloy containing about 15% Cr 17% Co, 5.3% Mo, 4% Al and 3.5% Ti;

providing a blade portion made from a second nickel base superalloy containing about 8.2% Cr, 10% Co, 0.6% Mo, 10% W, 3% Ta, 5.5% Al, and 1% Ti;

bonding said hub portion to said blade portion by hot isostatic pressure;

solution treating the bonded portions at about 2040° F. for about 2 hours;

reheating the bonded portions to about 1600° F. for about 16 hours, and again reheating the bonded portions to about 1400° F. for another 16 hours.

6. The method of claim 5 wherein said bonding step includes heating the two portions to about 2230° F. for about 4 hours under sufficient pressure and time to bond said hub portion to said blade portion.

7. A dual alloy turbine rotor produced by the method of claim 5 characterized by having improved creep-rupture properties as compared to prior methods.

8. A dual alloy turbine rotor comprising a hub portion composed of a first nickel base superalloy composition having high tensile strength at elevated temperatures, a blade portion composed of a second nickel base superalloy composition having high creep-rupture strength at elevated temperatures, said hub portion being metallurgically bonded to said blade portion to form a unitary rotor, and said rotor being heat treated after bonding by solutionizing at about 2040° F. and double aging, first at about 1600° F. and then at about 1400° F.

9. The turbine rotor of claim 8 wherein said hub portion is composed of consolidated powdered ASTROLOY superalloy.

10. The turbine rotor of claim 8 wherein said blade portion is composed of cast MAR M-247 superalloy.

* * * * *